United States Patent [19]

Lovold

[11] 3,980,741

[45] Sept. 14, 1976

[54] METHOD FOR THE PROCESSING OF BLACK POWDER

[75] Inventor: Kjell Lovold, Nittedal, Norway

[73] Assignee: Dyno Industrier A.S., Oslo, Norway

[22] Filed: Apr. 21, 1975

[21] Appl. No.: 569,681

[30] Foreign Application Priority Data

Apr. 22, 1974 Norway ..... 1437/74

[52] U.S. Cl. ..... 264/3 C; 149/72

[51] Int. Cl.[2] ..... C06B 21/00

[58] Field of Search ..... 264/3 R, 3 C; 149/72

[56] References Cited

UNITED STATES PATENTS 3,660,546 5/1972 Lovold ..... 149/72 X

*Primary Examiner*—Stephen J. Lechert, Jr.

*Attorney, Agent, or Firm*—Wenderoth, Lind & Ponack

[57] ABSTRACT

A method of continuously processing meal black powder in order to make it suitable for use in fuses, wherein a conventionally produced meal black powder is blended with about 20 % of water; said moist black powder is compressed to a coherent body in the form of sheets; said sheets are rubbed through a sieve; said sieved powder is agglomerated into spherical grains; said grains are dried to a moisture content of about 1 % and are sieved in order to provide a fraction having a grain size in the range of 0.3 and 1.0 mm.

3 Claims, No Drawings

METHOD FOR THE PROCESSING OF BLACK POWDER

In the manufacture of black powder fuses a fine grain, hard black powder is generally used as prepared in a generally used process comprising the following steps:

1. Grinding the three raw materials potassium nitrate, charcoal and sulfur to a fine grained size;
2. Blending the raw materials and further grinding thereof, so as to obtain a meal black powder;
3. Compressing the meal black powder to sheets having a density of 1.7 to 1.8;
4. Breaking the compressed sheets into fine grains (graining);
5. Sifting, polishing and coating with graphite;
6. Sifting and drying.

In the recent years fuses have also been produced by employing the meal black powder directly, that is without compressing, graining and polishing it. The drawback of this method is that the fuse tends to burn at a not constant rate. In order to obtain an evenly burning fuse the following two requirements must be fulfilled:

1. The powder must per se burn at a constant rate;
2. The powder must be able to be fed evenly to the fusecord.

In order to fulfil requirement (1), the raw materials must be crushed down to a high degree of fineness, at least 90% finer than 15 microns. Such a meal black powder can hardly and perhaps not at all be fed evenly into the fuse. In other words, these two conditions are not readily compatible with a simple meal black powder, and this is the reason for the varying burning-times which often occur.

The method comprises: One starts with a suitable meal black powder of sufficient fineness (at least 90% finer than 15 microns) and of a suitable composition, e.g.:

68 % of potassium nitrate
20 % of sulfur
12 % of charcoal

The meal black powder is prepared in any known way, such as, e.g., by means of ball mills, jet mills, wheel mills or in other ways. To the meal black powder is added a suitable amount of water, such as, e.g., about 20 %, in a suitable blending apparatus. The moist powder is compressed lightly, for instance between two belts, between belts and rollers, between two rollers or in a hydraulic press. The compressing shall be strong enough for the powder to form a coherent body after compressing. The powder is then rubbed through a sieve having a suitable mesh size, e.g., 0.5 mm and is thereafter passed into a rotating, circular container in which the powder agglomerates to spherical grains.

The agglomeration is continued until the grains have achieved a size of maximum 1 mm. This takes place during about 5 minutes. The powder grains are then passed into a suitable drying device, preferably of the fluidized bed type, wherein the moisture is reduced from 20 % to about 1 % by means of hot (70°C.), dry air. After the drying process the powder is sifted so that the grain size of the accepted powder lies between 1.0 mm and 0.3 mm. The finer and coarser fractions are returned to the raw material mills and are reground with the raw materials.

This method is particularly well suited for continuous and automatic operations. This is of great importance as seen from a safety point of view because by automatic operations it is no longer necessary for the operators to be present in the danger zone during the powder production, and in continuous processes the amounts of explosives being momentarily produced will at any time be significantly less than in discontinuous production processes.

In continuous and automatic production it is highly suitable to prepare the meal black powder according to Norwegian Pat. No. 118,356. The meal black powder will then fall into the blending or kneading apparatus in which the water is added at the same time as the powder is transported through the apparatus, and the moist powder falls out and directly into the rolling mill. The sieving device is located underneath the rolling mill. It is equipped with a rotating brush which brushes the powder through the sieve. Underneath the sieving device the rotating agglomeration cylinder is located. It is obliquely arranged so that the powder moves therethrough at the same time as it is rolled and agglomerated to spherical grains. The drying apparatus is located underneath the agglomeration cylinder and while being dried the powder is moved through the dryer. At the end of the dryer the sieving device is located. It is equipped with two sieving cloths to that the fraction of accepted size is drawn off in the centre. The fractions which are too coarse and too fine are combined and transported continuously back to the mill by means of a vibration transporter.

The advantages of the present method in relation to conventional production of highly compressed black powder are numerous and great:

1. In the major part of the production process the powder has a high degree of moisture (about 20 % of water), which makes it substantially not ignitious, and at least very hardly ignitious relative to conventional black powder having a moisture content of maximum 5 %.
2. The complicated and rather time-consuming compressing of the powder is avoided.
3. The time-consuming and particularly hazardous graining of the powder is avoided.
4. The highly time-consuming polishing of the powder is avoided.
5. The production capacity is much greater than in a conventional plant of the same size.
6. The need for operators is small in an automatic plant, and in combination with item 5) this gives a very cheap powder.

The percentage values set forth in the foregoing specification are, in accordance with accepted practice in the art, percentages by weight.

We claim:

1. A continuous process for treating meal black powder in order to produce black powder suitable for use in fuses, which comprises blending meal black powder with about 20% by weight of water, compressing the moist powder to a sufficient degree so as to obtain a coherent body, and thereafter rubbing through a sieve, agglomerating said sieved powder to spherical grains which are dried to a moisture content of about 1% and seiving to a grain size lying between 0.3 and 1.0 mm.

2. The method of claim 1, wherein the powder is dried in a fluidized bed.

3. The method of claim 1, wherein the powder is dried with air at 70°C.

* * * * *